US005125440A

United States Patent [19]

Mette

[11] Patent Number: 5,125,440

[45] Date of Patent: Jun. 30, 1992

[54] APPARATUS FOR FILLING BOTTLES AND THE LIKE

[75] Inventor: Manfred Mette, Hamburg, Fed. Rep. of Germany

[73] Assignee: alfill Getränketechnik GmbH, Hamburg, Fed. Rep. of Germany

[21] Appl. No.: 568,273

[22] Filed: Aug. 15, 1990

[30] Foreign Application Priority Data

Aug. 24, 1989 [DE] Fed. Rep. of Germany ..... 3928009

[51] Int. Cl.[5] ..... B65B 3/30; B65B 3/14

[52] U.S. Cl. ..... 141/39; 141/45; 141/51; 141/147; 141/145; 222/440; 222/442

[58] Field of Search ..... 141/6, 39, 40, 44–51, 141/54, 57–59, 61, 144–147, 151–152, 181, 182, 177, 251, 258, 266, 263, 264, 269, 284, 383, 387, 388, 301, 302, 308, 94, 95; 222/425, 434, 438, 440, 442, 450

[56] References Cited

U.S. PATENT DOCUMENTS

| | | | |
|---|---|---|---|
| 362,393 | 5/1887 | Muller | 222/442 X |
| 1,523,607 | 1/1925 | Prael | 141/147 X |
| 1,763,971 | 6/1930 | Kantor et al. | 222/438 X |
| 2,144,628 | 1/1939 | Hothersall | 141/263 X |
| 2,466,731 | 4/1949 | Nordquist | 141/94 |
| 2,506,125 | 5/1950 | White | 222/438 X |
| 2,761,606 | 9/1956 | Pahl et al. | 141/146 X |
| 3,065,887 | 11/1962 | Matejek | 141/146 X |
| 3,464,464 | 9/1969 | Laub | 141/145 X |
| 3,830,264 | 8/1974 | Billett et al. | 141/147 X |
| 4,043,490 | 8/1977 | McKinney | 222/442 |
| 4,124,043 | 11/1978 | Noguchi | 141/6 |
| 4,398,575 | 8/1983 | Brandon | 141/39 |
| 4,589,453 | 5/1986 | Weiss | 141/39 |

FOREIGN PATENT DOCUMENTS

| | | | |
|---|---|---|---|
| 0033334 | 5/1924 | Denmark | 141/145 |

*Primary Examiner*—Henry J. Recla
*Assistant Examiner*—Casey Jacyna
*Attorney, Agent, or Firm*—Peter K. Kontler

[57] ABSTRACT

Apparatus for admitting metered quantities of a liquid into discrete containers in the form of bottles, cans or the like has a rotary annular tank which carries at its underside a ring-shaped set of filling units each of which has a discrete metering vessel serving to receive a metered quantity of liquid from the interior of the tank for admission into a container which is placed into alignment with a centering and sealing sleeve movably mounted on each metering vessel. If the liquid is to be admitted into the containers at an elevated pressure, the supply of liquid in the tank is disposed beneath a plenum chamber and each filling unit is designed to admit compressed gas from the plenum chamber into the aligned container prior to admission of a metered quantity of liquid. The liquid which flows into a container expels the compressed gas which is returned into the plenum chamber or into a separate receptacle. The liquid-receiving capacity of the metering chamber in each vessel can be varied by an adjustable insert which can be manipulated from above the tank. The metering vessels can be located beneath the bottom wall of the tank or an upper section of each metering vessel can extend into the tank.

30 Claims, 5 Drawing Sheets

APPARATUS FOR FILLING BOTTLES AND THE LIKE

BACKGROUND OF THE INVENTION

The invention relates to improvements in apparatus for introducing metered quantities of liquids into bottles, cans or other types of containers.

Heretofore known filling apparatus employ a vessel (hereinafter called tank for short) which stores a supply of liquid, and a plurality of so-called filling heads which are equipped with shutoff valves and serve to transfer metered quantities of liquid from the tank into discrete containers which are delivered to positions of register with the outlets of the filling heads. As a rule, or at least in many instances, the liquid is discharged by gravity and flows into a container as long as the respective shutoff valve remains open.

If the liquid in the tank is maintained at an elevated pressure, e.g., if the liquid is a carbonated beverage, the apparatus employs filling heads which are designed to raise the pressure in the containers prior to admission of liquid so that the pressure in an empty container which is about to receive a metered quantity of liquid matches the pressure of liquid in the tank. The step of raising the pressure in an empty container prior to admission of a metered quantity of liquid includes the introduction of a compressed gas which is thereupon expelled from the container by the inflowing pressurized liquid. In many instances, the filling heads which are used for admission of pressurized liquids comprise pipes serving to confine the expelled compressed gases to the flow into the gas-filled space above the body of liquid in the tank. The liquid can fill the tank to a level which is below the upper (discharge) ends of the aforementioned pipes, and its upper level fluctuates which is not conducive to the admission of accurately metered quantities of liquid into each of a short or long series of containers in the form of bottles, cans, jars or the like. Moreover, it is difficult to rapidly alter the quantities of liquid which are to be admitted into containers.

OBJECTS OF THE INVENTION

An object of the invention is to provide an apparatus which can admit accurately metered quantities of a liquid into each of a short or long series of containers.

Another object of the invention is to provide the apparatus with novel and improved means for selecting the quantities of liquid which are to be admitted into bottles, cans, jars or other types of containers.

A further object of the invention is to provide an apparatus wherein fluctuations of the quantity of liquid which is confined in the tank cannot influence the quantities of liquid which are admitted into discrete containers.

An additional object of the invention is to provide an apparatus which is constructed and assembled in such a way that the streams of liquid which are discharged from the tank to flow into discrete containers are not agitated, or are not excessively agitated, during flow from the interior of the tank into individual containers.

Still another object of the invention is to provide the apparatus with novel and improved means for raising the pressure in containers prior to admission of metered quantities of a pressurized liquid.

A further object of the invention is to provide an apparatus which can fill large numbers of containers per unit of time in a small area.

SUMMARY OF THE INVENTION

The invention is embodied in an apparatus for filling containers (e.g., bottles or cans) with a liquid (such as a carbonated beverage). The improved apparatus comprises a liquid-containing tank, at least one metering vessel having at least one sealable inlet for reception of liquid from the tank and at least one sealable outlet for admission of a metered quantity of liquid into a container, and a container-centering and sealing device (e.g., an axially reciprocable sleeve) on the vessel.

At least a portion of the vessel can be disposed in the tank. For example, the arrangement may be such that the vessel has a first section or portion beneath and a second portion or section in the tank. The first section of the vessel can resemble a cup, and the vessel defines a liquid-receiving liquid metering chamber having a first portion in the first section and a second portion in the second section.

The vessel can constitute a separately produced unit which extends from below through the bottom wall of the tank and into the interior of the tank. Such vessel can have a plurality of inlets within the tank, and the apparatus then further comprises at least one valve for the inlets. The valve is movable relative to the vessel between a first position in which the inlets establish paths for the flow of liquid from the tank into the metering chamber of the vessel and a second position in which the inlets are sealed.

The at least one inlet can be disposed between the first and second sections of the vessel (i.e., between the section which is located beneath the tank and the section which is located in the tank), and the second section is then movable relative to the first section between a first position in which the at least one inlet is exposed to establish a path for the flow of liquid from the tank into the metering chamber and a second position in which the at least one inlet is sealed.

The apparatus can further comprise means for varying the liquid-receiving capacity of the metering chamber. Such capacity varying means can comprise an insert (e.g., a plunger or piston) which is movable relative to the vessel to occupy a selected portion of the metering chamber.

The tank has a compartment including a liquidcontaining lower portion and an upper portion which can constitute a gas-filled plenum chamber above the body of liquid in the tank. Such apparatus can comprise at least one conduit which provides a path for the flow of gas between the plenum chamber and the liquid-receiving metering chamber of the vessel. The liquid fills the tank to a first level, and the path which is defined by the conduit has a lower portion in communication with the metering chamber beneath the first level and an upper end in communication with the plenum chamber above the first level. Such apparatus preferably further comprises a float valve which is provided in the conduit and serves to seal the path between the metering chamber and the plenum chamber in response to filling of the vessel with liquid to a second level below the first level. At least a portion of the conduit can form part of the aforementioned insert which serves to vary the capacity of the metering chamber in the vessel.

The centering device is preferably mounted for up-and-down movement along that portion or section of the vessel which extends below the tank. Such portion or section of the vessel can include a hollow upright cylinder having an external surface which is surrounded by and guides the centering device.

The compressed gas which fills the plenum chamber of the compartment in the tank can be air, $CO_2$ gas or any other gas which does not adversely affect the characteristics of the liquid in the tank.

The apparatus can further comprise a pipe having a first end in communication with the interior of a container which is centered by the centering device and a second end which is connected or connectable to the plenum chamber of the compartment in the tank. Such pipe can extend through the at least one outlet, through the metering vessel and into the tank. The apparatus can further comprise means for moving the pipe between first and second positions, and a valve which serves to seal the at least one outlet. The valve includes a valving element which is provided on the pipe and serves to seal the at least one outlet in one position of the pipe. The pipe is preferably an upright pipe and the first end of such pipe is its lower end. The moving means preferably includes means (e.g., a cam and follower assembly) for moving the pipe axially between a lowered position corresponding to the one position of the pipe and a raised position corresponding to the other position.

The pipe can contain a check valve which serves to prevent the escape of compressed gas from the upper portion (plenum chamber) of the compartment in the tank by way of the pipe when the pressure at the first end of the pipe is below the pressure in the plenum chamber. This prevents escape of compressed gas from the tank into the atmosphere when the centering device does not center and sealingly engage a container.

The apparatus can further comprise a receptacle (e.g., a hollow superstructure on top of the tank) which defines a chamber wherein the pressure is less than that in the plenum chamber, and means for selectively connecting the second end of the pipe with the upper portion of the compartment in the tank (i.e., with the plenum chamber) or with the chamber of the receptacle. The connecting means preferably includes means for sealing the second end of the pipe from the plenum chamber when the at least one outlet of the vessel admits a metered quantity of liquid into the container which is centered and sealed by the centering device. As mentioned above, the pipe can carry a valving element which seals the at least one outlet in a first position of the pipe relative to the vessel and permits a metered quantity of liquid to leave the metering chamber in a second position of the pipe.

The tank can constitute a rotary annular tank, and such apparatus can further comprise additional metering vessels each of which has at least one sealable inlet for reception of liquid from the rotary tank and at least one sealable outlet for admission of a metered quantity of liquid into a container. Such apparatus further comprises a container-centering and sealing device on each additional metering vessel. The metering vessels can form an annulus of equidistant vessels.

The at least one inlet can be provided at the lower end of each vessel, i.e., the liquid which is admitted into a vessel must flow upwardly to reduce the likelihood of splashing.

The apparatus can further comprise an additional conduit for each vessel, and each such conduit serves to connect the plenum chamber in the tank with the interior of a container which is centered by the centering device on the respective vessel. A shutoff valve is provided in each additional conduit.

If a metering vessel has a portion or section in the tank, the apparatus can further comprise means for removing such portion relative to the bottom wall of the tank between first and second positions in which the at least one inlet of such vessel is respectively open and sealed. The bottom wall of the tank can include a valve seat, and the section or portion of the vessel in the tank then includes a valving element which sealingly engages the seat in the second position of the section.

Each vessel can include a first portion or section which is integral with the bottom wall of and extends downwardly from the tank, and a second portion or section which is movably mounted in the interior of the tank. The centering device which cooperates with such vessel surrounds and is movable up and down relative to the first portion or section of the vessel.

If at least a portion of a vessel is disposed beneath the tank (i.e., if the vessel has a bottom portion which is remote from the bottom wall of the tank), the apparatus can further comprise a tube (which can be considered a component part of the tank) with a liquid-receiving first end immersed in the body of liquid in the tank and a liquid-discharging end adjacent the bottom portion of the vessel. The tube is surrounded by and defines with the vessel the aforementioned metering chamber. The at least one inlet of the vessel is preferably disposed between the bottom portion of the vessel and the liquid-discharging end of the tube. The centering device can include a sleeve which is movable up and down along and surrounds the portion of the vessel beneath the tank. The apparatus can further comprise means for moving the tube relative to the bottom portion of the vessel between a first position in which the at least one inlet admits liquid into the metering chamber (from the liquid-discharging end of the tube) and a second position in which the tube seals the at least one inlet. The tube can include or constitute a hollow upright cylinder and the moving means can include means for moving the cylinder axially between the first and second positions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
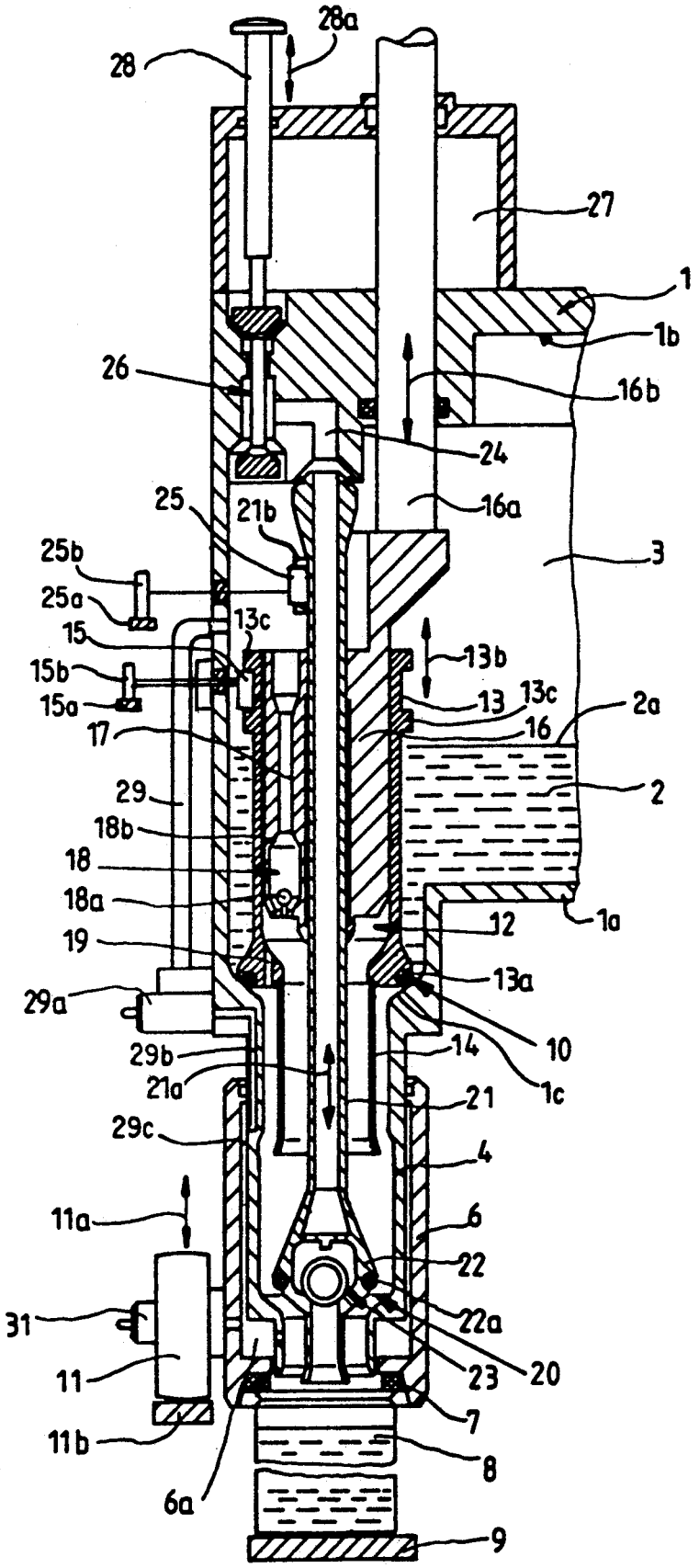
FIG. 1 is a greatly enlarged fragmentary vertical sectional view of a container filling apparatus which embodies one form of the invention, the section being taken in the direction of arrows as seen from the line I—I in FIG. 5.
Figure 5:
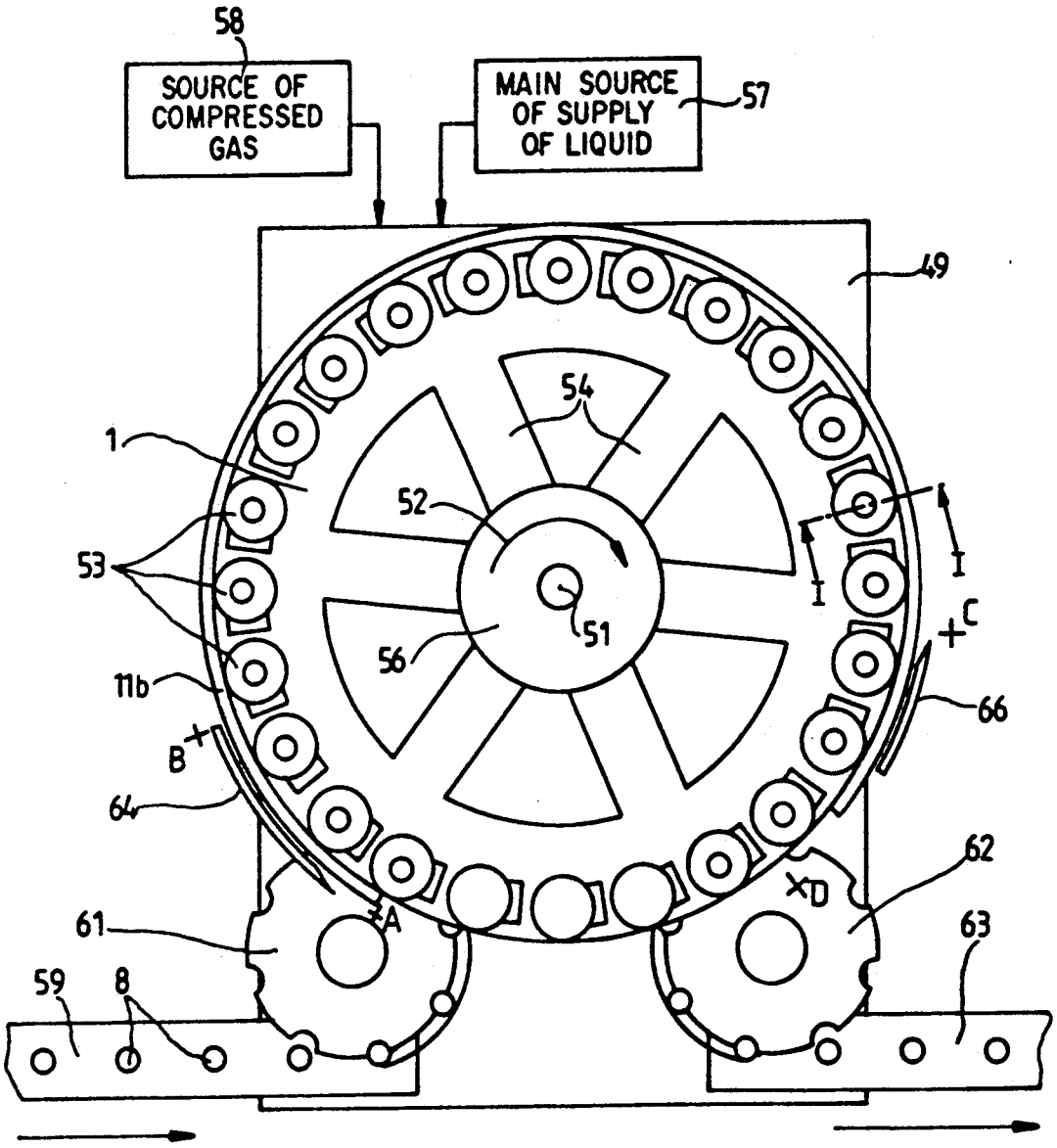
FIG. 5 is a schematic plan view of the apparatus which includes the structure of FIG. 1.

The apparatus which is shown in FIGS. 1 and 5 comprises a rotary annular liquid-containing tank 1 and means (including a shaft 51) for rotating the tank about a vertical axis. The tank 1 has an internal compartment lb the lower portion of which contains a body of liquid 2 (e.g., a carbonated beverage) and the upper portion of which constitutes a plenum chamber 3 containing a supply of compressed gaseous fluid. The level 2*a* of the upper surface of the body of liquid 2 in the compartment 1*b* is maintained constant in a well known manner not forming part of the invention and not shown in the drawing.

The bottom wall 1*a* of the tank 1 is integral with an annulus of equidistant vertical cup-shaped parts 4 which constitute the lower portions or sections of discrete liquid metering vessels 12. FIG. 5 shows an annulus of twentyfour equidistant filling units 53 each of which comprises a metering vessel; however, the number of filling units 53 can be increased or reduced without departing from the spirit of the invention. The major part of each section 4 is an upright cylinder having a cylindrical external surface which is surrounded by and guides a vertically movable container-centering and sealing device 6 (hereinafter called sleeve for short). The lower end portion of each sleeve 6 is provided with a ring-shaped sealing element 7 which can sealingly engage the open top of an upright container 8 (e.g., a can, a bottle or a jar) which rests on a movable platform 9 and is to receive a metered quantity of liquid 2.

If desired, the sealing element 7 can be replaced with a sealing element which is designed to engage the external surface of the container 8 on the adjacent platform 9. Reference may be had to commonly owned copending patent application Ser. No. 07/562,486 filed Aug. 3, 1990 by Mette for "Apparatus for filling bottles and the like" which describes a centering sleeve with a sealing element serving to engage the external surface of the open upper end portion of a container which is to receive a metered quantity of liquid. The copending patent application further describes means for pneumatically biasing the sealing element against the external surface of the container which extends into the centering sleeve.

The centering sleeve 6 is movable up and down (note the double-headed arrow 11*a* in FIG. 1) along the lower section or portion 4 of the respective metering vessel 12 by a cam and follower assembly 11*b*, 11. Such movements are necessary in order to properly engage the sealing element 7 with the open top of the container 8 on the adjacent platform 9 as well as to lift the sleeve 6 above and away from a filled container so that the latter can be transported away from the vessel 12 in order to provide room for advancement of a fresh (empty) container 8 to a position of register with the sleeve 6. The latter is designed to sealingly engage as well as to properly center the containers 8 relative to the corresponding metering vessels 12.

Each vessel 12 further comprises an upper portion or section 13 which is located in the compartment lb of the tank 1 and defines one portion of a liquidreceiving metering chamber. Another portion of the metering chamber is defined by the lower section 4 of the respective vessel 12. The upper section 13 of each vessel 12 is a hollow upright cylinder which is movable in the tank 1 up and down (note the double-headed arrow 13*b* in FIG. 1) and defines with the lower section 4 a sealable inlet 10 for admission of liquid 2 from the compartment 1*b* into the metering chamber of the vessel 12. The sections 4, 13 of each vessel 12 are coaxial with each other.

When the metering chamber of the vessel 12 which is shown in FIG. 1 is filled (i.e., when the vessel 12 contains an accurately metered quantity of liquid 2), the upper section 13 is moved to the lower end position of FIG. 1 in which it cooperates with the section 4 (i.e., with an integral portion of the bottom wall 1*a* of the tank 1) to seal the outlet 10. To this end, the lower section 4 (i.e., the bottom wall la) defines an annular valve seat 1*c* and the adjacent portion of the section 13 constitutes a valving element with a ringshaped seal 13*a* which engages the seat 1*c* in the lower end position of the section 13.

The means for moving the section 13 of each vessel 12 up and down in order to expose and seal the respective inlet 10 comprises an eccentric 15 which extends into an external circumferential groove of the section 13 and can be turned by a cam and follower assembly 15*a*, 15*b*. The shaft which connects the eccentric 15 with the follower 15*b* extends through the peripheral wall of the tank 1. The external groove of each section 13 is bounded by two ring-shaped collars 13*c*.

The lower part of the vertically movable section 13 of each vessel 12 is constituted by an upright tubular skirt 14 which extends downwardly from the valving element including the seal 13*a* into the section 4 and serves to establish an optimum flow of liquid 2 from the lower portion of the compartment lb into the metering chamber of the vessel 12 when the inlet 10 is open as a result of lifting of the seal 13*a* above and away from the seat 1*c*.

Each vessel 12 is further provided with means for varying the liquid-receiving capacity of the respective metering chamber. Such varying means includes a plunger-like insert 16 which is vertically movably installed in the upper section 13 of the vessel 12 and can be moved to any one of a plurality of different positions in order to occupy a selected portion of the respective metering chamber. The upper end of each section 13 is open to permit introduction of the respective insert 16, and such insert is movable up and down (arrow 16*b*) between selected positions by a reciprocable rod 16 which extends through and upwardly and beyond the top wall of the tank 1 so that it is accessible above the tank. The insert 16 further serves as a means for confining the respective section 13 to movements in directions which are indicated by the double-headed arrow 13*b* of FIG. 1, i.e., in such a way that the reciprocable section 13 remains coaxial with the lower section 4.

Each filling unit 53 of the apparatus of FIG. 5 further comprises a conduit 17 which, in the embodiment of FIGS. 1 and 5, is an integral portion of the respective insert 16 and defines a vertical path for the flow of compressed gas between the plenum chamber 3 and the metering chamber of the respective vessel 12. The lower portion of the conduit 17 contains a float valve 18 which automatically seals the path for the flow of gas between the plenum chamber 3 and the respective metering chamber when the liquid in the metering chamber rises to a predetermined level, namely to a level below the at least substantially constant level 2*a* of liquid in the compartment 1*b* of the tank 1. The illustrated float valve 18 comprises a spherical float 18*a* which is confined to movements in an enlarged portion or chamber of the path or passage defined by the conduit 17. The lower end of such path is located below and the upper end of the path is located above the level 2a of liquid 2 in the tank 1.

A vertical bore 19 in the section 13 establishes a connection between the lower portion of the metering chamber in the section 4 and the upper portion of such metering chamber in the section 13. The bore 19 is outwardly adjacent the skirt 14 of the section 13.

The insert 16 axially movably supports and guides a vertical pipe 21 which serves to convey compressed gas into a container 8 beneath the sleeve 6 as well as to provide a path for expulsion of gas from such container when an outlet 20 between the lower end of the pipe 21 and the adjacent portion of the section 4 is open to permit a metered quantity of liquid 2 to flow from the metering chamber of the vessel 12 into the container on the adjacent platform 9. The means for moving the pipe 21 up and down (arrow 21a in FIG. 1) is analogous to the moving means for the section 13. FIG. 1 shows an eccentric 25 between two external radial projections 21b at the upper end of the pipe 21 and a cam and follower assembly 25a, 25b outside of the tank 1. The follower 25b can turn the eccentric 25 to thereby move the pipe 21 between a raised position in which the outlet 20 is open and a lowered position in which the outlet 20 is sealed.

The valve which controls the flow of liquid from the metering chamber of the vessel 12 into a container 8 beneath the sleeve 6 of FIG. 1 comprises a valving element 22 with a ring-shaped seal 22a at the lower end of the pipe 21 and an annular internal valve seat in the lower part of the section 4.

A check valve 23 in the lower portion of the pipe 21 automatically seals the plenum chamber 3 in the tank 1 from the atmosphere or from the interior of the container 8 beneath the sleeve 6 if the pressure of gas above this check valve exceeds the pressure therebelow. The illustrated check valve 23 is a standard ball check valve.

The upper end of the pipe 21 is movable into and from sealing engagement with a connecting device 24 in the top wall of the tank 1. The device 24 cooperates with a vertically reciprocable valving element 26 of a shuttle valve which serves to selectively connect the interior of the pipe 21 with the plenum chamber 3 or with a chamber in the receptacle 27 in the form of a hollow superstructure on top of the tank 1. The pressure in the chamber of the receptacle 27 is less than the pressure in the plenum chamber 3. The valving element 26 can be moved by a reciprocable pusher 28 (arrow 28a in FIG. 1) between a raised position in which the chamber of the receptacle 27 communicates with the interior of the pipe 21 when the latter is held in the raised position so that its upper end sealingly engages the connecting device 24 in order to seal the interior of the pipe from the plenum chamber 3, and a lower position in which the connecting device 24 is sealed from the chamber in the receptacle 27 and the upper end of the passage in the pipe 21 can receive compressed gas from the plenum chamber 3 when the pipe 21 engages the device 24 as well as when the pipe 21 is lowered to seal the outlet 20.

The receptacle 27 can constitute an annulus which is concentric with the annular tank 1.

If the liquid 2 in the tank 1 is maintained at an elevated pressure, the pressure in an annular space 6a of the sleeve 6 should be raised to match the pressure in the compartment 1b of the tank. To this end, each filling unit 53 comprises an additional conduit 29 which can establish communication between the plenum chamber 3 and the internal space 6a of the sleeve 6. The flow of compressed gas in the conduit 29 is controlled by a shutoff valve 29a. The lower end of the additional conduit 29 serves to admit compressed gas into a bore 29b in the section 4, and the bore 29b admits compressed gas into an annular clearance 29c between the external surface of the section 4 and the internal surface of the sleeve 6. The clearance 29c admits compressed gas into the ring-shaped internal space 6a of the sleeve 6, and this internal space communicates with the interior of the container 8 which is engaged by the sealing element 7. The arrangement is such that a pressure differential between the space 6a and the interior of the container 8 entails additional deformation of the sealing element 7 to further reduce the likelihood of escape of compressed gas and/or liquid 2 from the container.

A valve 31 is opened to reduce the pressure in the space 6a when the filling of a container 8 with a pressurized or highly pressurized liquid is completed.

The operation of the filling unit 53 including the vessel 12 of FIG. 1 is as follows:

It is assumed that the liquid 2 in the tank 1 is a beverage which contains $CO_2$ gas. It is further assumed that the gas in the plenum chamber 3 above the body of liquid 2 in the tank 1 is maintained at an elevated pressure. The pressure in the chamber of the receptacle 27 is less than the pressure in the compartment 1b of the tank 1.

The moving means 15, 15a, 15b maintains the upper section 13 of the vessel 12 in the lower end position in which the valving element including the seal 13a cooperates with the seat 1c to seal the inlet 10 against admission of liquid 2 from the tank 1 into the metering chamber of the vessel 12. The valving element 22 at the lower end of the pipe 21 seals the outlet 20. A turnstile-type rotary transfer member 61 (FIG. 5) has advanced an empty container 8 to a position of alignment with the sleeve 6 of FIG. 1. The follower 11 then cooperates with the cam 11b to lower the sleeve 6 relative to the lower section 4 of the vessel 12 so that the sealing element 7 engages the upper end of the container 8 on the platform 9 and seals the interior of the container from the atmosphere. The shutoff valve 29a is opened so that the additional conduit 29 admits compressed gas from the plenum chamber 3 into the internal space 6a of the sleeve 6. The resulting pressure differential between the space 6a and the interior of the container 8 results in additional deformation of the sealing element 7 in order to prevent compressed gas from escaping into the atmosphere.

The valving element 22 continues to seal the outlet 20 while the upper section 13 of the vessel 12 is lifted by the moving means 13c, 15, 15a, 15b so that the inlet 10 is exposed and a stream of liquid 2 is free to flow from the tank 1 into the metering chamber of the vessel 12. The cylindrical skirt 14 causes the stream of inflowing liquid 2 to form a hollow cylinder and to fill the metering chamber with a minimum of splashing and/or foaming. The inflowing liquid 2 expels the gas from the metering chamber of the vessel 12 by way of the conduit 17 in the insert 16. As the level of liquid in the vessel 12 rises, the spherical valving element 18a of the float valve 18 rises and engages a seat 18b to seal the path for the expulsion of gas from the metering chamber before the liquid in such path rises to the level 2a. The eccentric 15 is thereupon caused to lower the section 13 so that the inlet 10 is sealed while the vessel 12 confines an accurately metered quantity of liquid.

The exact quantity of liquid in the metering chamber of the vessel 12 is determined by the position of the insert 16. The level of this insert can be selected by moving the rod 16*a* up or down in one of the directions which are indicated by the double-headed arrow 16*b*.

The shutoff valve 29*a* is thereupon closed and the pipe 21 is lifted by the moving means 21*b*, 25, 25*a*, 25*b* so that the valving element 22 exposes the outlet 20 and permits the metered quantity of liquid 2 to descend from the metering chamber of the vessel 12 into the container 8 beneath the sleeve 6. The upper end of the lifted pipe 21 sealingly engages the connecting device 24 which at first continues to establish communication between the plenum chamber 3 and the interior of the pipe 21 because the pusher 28 maintains the valving element 26 of the shuttle valve in the lower end position in which the chamber of the receptacle 27 is sealed from the connecting means 24. In other words, the liquid which flows from the metering chamber of the vessel 12 into the container 8 below the sleeve 6 expels the gas from the interior of the container 8 through the pipe 21, connecting device 24 and shuttle valve into the plenum chamber 3.

In order to accelerate the transfer of a metered quantity of liquid from the vessel 12 into the container 8, the pusher 28 can be caused to lift the valving element 26 during a selected stage of the filling operation so as to seal the connecting device 24 and the pipe 21 from the plenum chamber 3 and to connect the interior of the pipe 21 with the chamber in the receptacle 27 wherein the pressure is less than in the plenum chamber 3. This results in the generation of a suction effect which facilitates more rapid filling of the container 8 to thus increase the output of the improved apparatus.

The lower end of the pipe 21 does not come in contact with the metered quantity of liquid 2 which has been admitted into the container 8 below the sleeve 6. This is desirable and advantageous because only a very short upward stroke of the sleeve 6 (by way of the follower 11 and cam 11*b*) is necessary to lift the sleeve above the filled container and to permit replacement of the filled container with an empty container. Such design of the filling unit 53 contributes to a higher output and greater economy of the apparatus.

The valve including the valving element 22 is caused to seal the outlet 20 (as a result of lowering of the pipe 21) as soon as the transfer of a metered quantity of liquid 2 into the container 8 below the sleeve 6 is completed. The next step includes opening of the relief valve 31 so that the pressure above the supply of liquid in the container matches atmospheric pressure. Such reduction of pressure in the uppermost portion of the filled container 8 entails automatic sealing of the lower end of the pipe 21 by the check valve 23 to prevent uncontrolled escape of compressed gas from the plenum chamber 3 or from the chamber of the receptacle 27. The next step involves lifting of the sleeve 6 by the follower 11 in cooperation with the cam 11*b* in order to raise the lowermost portion of the sleeve above the top of the freshly filled container. The latter is then moved away from the sleeve 6 by a second turnstile-type transfer member 62 (FIG. 5). The tank 1 and its filling units 53 including the metering vessels 12 are rotated in a clockwise direction (arrow 52 in FIG. 5) so that a sleeve 6 which has been lifted above a freshly filled container 8 rapidly returns to the transfer member 61 which places a fresh (empty) container 8 to a position of alignment with the respective section 4 and the filling operation is then repeated in the aforedescribed manner.

If the freshly filled containers 8 are to be sealed (e.g., by the application of screw caps or in any other suitable way), each filling unit 53 can include a sealing or capping unit, e.g., a capping unit of the type described and shown in commonly owned copending patent application Ser. No. 07/568,254 filed Aug. 5, 1990 by Mette for "Method of and apparatus for filling containers with liquids".

The exact details of the means (21*b*, 25, 25*a*, 25*b*) for moving the pipe 21 of each filling unit 53 up and down form no part of the present invention. Such moving means are known in the art of apparatus for filling bottles, cans and other types of containers.

FIG. 5 shows that the annular tank 1 is mounted on and can rotate relative to a stationary base or bed 49. The shaft 51 receives torque from a suitable prime mover to rotate the tank 1 in a clockwise direction as indicated by the arrow 52. This tank carries a total of twentyfour filling heads 53 which form a complete annulus and are equidistant from each other. Each filling head 53 comprises a metering vessel 12 and a centering and sealing sleeve 6. These filling units are actually located beneath the tank 1, i.e., they are not visible in FIG. 5. Nevertheless, they are schematically represented by circles to point out their positions relative to each other.

The reference character 56 denotes in FIG. 5 a reservoir for a supply of liquid 2. The reservoir 56 is connected with the tank 1 by several radially extending conduits 54 and shares the angular movements of the tank about the axis of the shaft 51. A main source 57 of supply of liquid is mounted on or at the base 49 and is connected with the reservoir 56 to supply liquid which is thereupon admitted into the tank 1. The exact manner in which the rotating reservoir 56 is connected with the stationary main source 57 of liquid 2 is known in the art and need not be described here. For example, the admission of liquid from the source 57 into the reservoir 56 can be effected in the axial direction of the shaft 51. As mentioned above, the apparatus comprises suitable means for ensuring that the level 2*a* of the body of liquid 2 in the compartment 1*b* of the tank 1 remains unchanged or fluctuates only within a very narrow range.

A source 58 of compressed gas serves to supply gas to the plenum chamber 3, preferably in the axial direction of the shaft 51 and thereupon radially outwardly. This source ensures that the pressure of gas in the plenum chamber 3 remains at least substantially constant. If the liquid 2 in the tank 1 is a carbonated beverage, the source 58 normally contains a supply of compressed $CO_2$ gas.

Empty containers 8 are supplied by a first conveyor 59 which advances successive foremost containers into the range of the transfer member 61. The latter advances such containers onto the platforms 9, i.e., to positions of alignment with the sleeves 6 on the metering vessels 12 of successive filling units 53. Successive filled containers 8 reach the transfer member 62 which delivers them to a second conveyor 63 for advancement to storage or to a boxing, crating or other processing station.

As already described with reference to FIG. 1, the sleeves 6, the sections 13 and the pipes 21 of successive filling units 53 are movable up and down by cam and follower assemblies 11, 11*b* and 15*a*, 15*b* and 25*a*, 25*b*, respectively. FIG. 5 shows that the cam 11*b* extends around the tank 1 practically all the way from a point A (where successive empty containers 8 reach the sleeves 6 of successive filling units 53) to the point D (where successive filled containers 8 are taken over by the transfer member 62). The endless path of the platforms 9 for the containers 8 coincides with the endless path of the filling units 53.

The portion A-B of the path A-D of containers 8 with the respective filling units 53 is adjacent a further stationary cam 64 which acts upon the valves 29*a* of successive units 53 to permit the flow of compressed gas from the plenum chamber 3, through the respective additional conduits 29 and into the internal spaces 6*a* of the corresponding sleeves 6.

The path portion A-B is followed by a second portion B-C along which successive filling units 53 advance during admission of metered quantities of liquid 2 from the metering chambers of the respective vessels 12 into the containers 8. The cams 15*a* and 25*a* (not shown in FIG. 5) are adjacent the path portion B-C to ensure automatic emptying of successive metering chambers in the aforedescribed manner.

The path portion B-C is followed by a path portion C-D along which the filling units 53 advance during reduction of pressure in the filled containers 8. To this end, the apparatus of FIG. 5 comprises an additional stationary cam 66 which actuates successive relief valves 31 in order to reduce the pressure in the internal spaces 6*a* of the respective sleeves 6. The downstream end of the cam 11*b* (nearest to the point D) thereupon lifts successive sleeves 6 so that the filled containers 8 can be accepted by successive sockets or flutes in the peripheral surface of the rotary transfer member 62 for delivery onto the conveyor 63.

The metering chambers of successive vessels 12 are filled with liquid 2 during advancement along the path portion D-A, i.e., from the transfer member 62 back to the transfer member 61. Thus, a vessel 12 which reaches the point A already contains a metered quantity of liquid 2.

It is clear that the cams and followers which are shown in FIGS. 1 and 5 constitute but one of a variety of available means for moving the sleeves 6 on the sections 4 of successive vessels 12, for moving the upper sections 13 of successive vessels 12, for moving the pipes 21 of successive filling units 53, for actuating the valves 29*a* and 31 of successive filling units as well as for moving other parts (such as the pushers 28 for the valving elements 26 of the shuttle valves in the tank 1). The exact configuration of the cams will determine those stages during each revolution of the tank 1 when the various valves are open or closed, when the inlets 10 and outlets 20 are open and closed, when the containers 8 are pressurized and/or when the upper ends of the pipes 21 communicate with the plenum chamber 3 or with the chamber of the receptacle 27.

Figure 2:
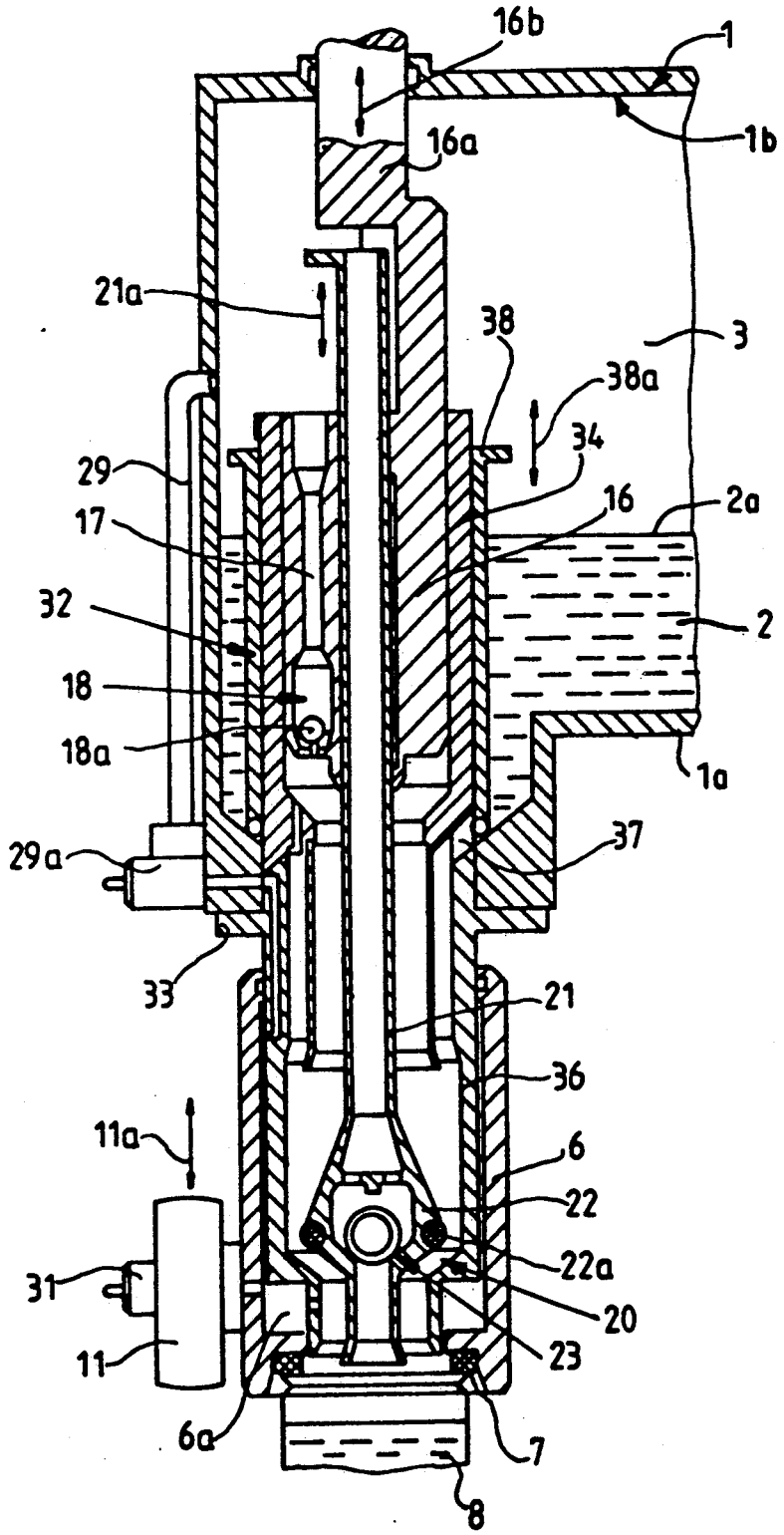
FIG. 2 is a similar fragmentary vertical sectional view of a modified apparatus.

FIG. 2 shows a portion of a second apparatus wherein all such parts which are identical with or clearly analogous to corresponding parts of the apparatus of FIGS. 1 and 5 are denoted by similar reference characters. The main difference between the apparatus of FIGS. 1 and 2 is that the apparatus of FIG. 2 has filling units with different metering vessels 32 and that the reservoir 27 of FIG. 1 is omitted. The substantially cylindrical one-piece upright metering vessel 32 of FIG. 2 is a separately produced part which is installed in the bottom wall 1*a* of the annular tank 1 in such a way that its lower portion or section 36 is located below and that its upper portion or section 34 is located above the bottom wall, i.e., the section 34 is confined in the compartment 1*b* of the tank 1. An external flange 33 between the sections 34, 36 of the vessel 32 is bolted, welded or otherwise secured to the underside of the bottom wall 1*a*. The upper end of the section 34 is located above the liquid level 2*a* in the compartment 1*b*, i.e., in the plenum chamber 3. The section 34 receives a portion of the insert 16 which is movable up and down (arrow 16*b*) by the rod 16*a* to occupy a selected portion of the metering chamber in the vessel 32, i.e., to determine the quantity of liquid which can flow from the tank 1 into the vessel 32 in response to opening of one or more (preferably an annulus of equidistant) inlets 37 which are machined into or are otherwise formed in the upper section 34 at the bottom wall la and above the flange 33. The insert 16 contains or includes the conduit 17 which, in turn, contains a flat valve 18 serving the same purpose as the similarly referenced float valve of the filling unit 53 which is shown in FIG. 1.

The preferably cylindrical external surface of the lower section 36 of the vessel 32 guides a vertically movable centering and sealing sleeve 6 which carries the sealing element 7 and is movable up and down (arrow 11*a*) by a follower 11 cooperating with a cam 11*b* (not shown in FIG. 2).

The valve which is used to expose or seal the inlets 37 in the upper section 34 of the vessel 32 includes a cylindrical valving element 38 which surrounds the section 34 and is movable up and down (arrow 38*a*) by a cam and follower assembly corresponding to one of the assemblies 15*a*, 15*b* and 25*a*, 25*b* of FIG. 1.

The operation of the filling unit which is shown in FIG. 2 is in part identical with and in part analogous to that of the filling unit 53 of FIG. 1. The filling unit of FIG. 2 is simpler because it does not employ a receptacle 27, i.e., it is not possible to accelerate the admission of a metered quantity of liquid 2 into the container 8 beneath the sleeve 6 of FIG. 2 because the pressure in the container equals the elevated pressure in the plenum chamber 3 of the tank 1. However, it is clear that the apparatus which comprises the filling unit of FIG. 2 can also include a receptacle 27 and shuttle valves (with valving elements 26) and connecting devices 24 if the designer wishes to ensure that the transfer of metered quantities of liquid 2 into the containers 8 be accelerated by reducing the pressure in the container below that prevailing in the plenum chamber 3 of the tank 1.

An advantage of the apparatus which employs metering vessels 32 of the type shown in FIG. 2 is that the assembly of the apparatus is simpler and requires less time than the assembly of the apparatus of FIG. 1 because each vessel 32 constitutes a prefabricated unit which can be assembled with the respective sleeve 6, pipe 21, valve 22, 22*a*, valve 23 and certain other parts prior to insertion of the upper section 34 into the compartment 1*b* of the tank 1.

Figure 3:
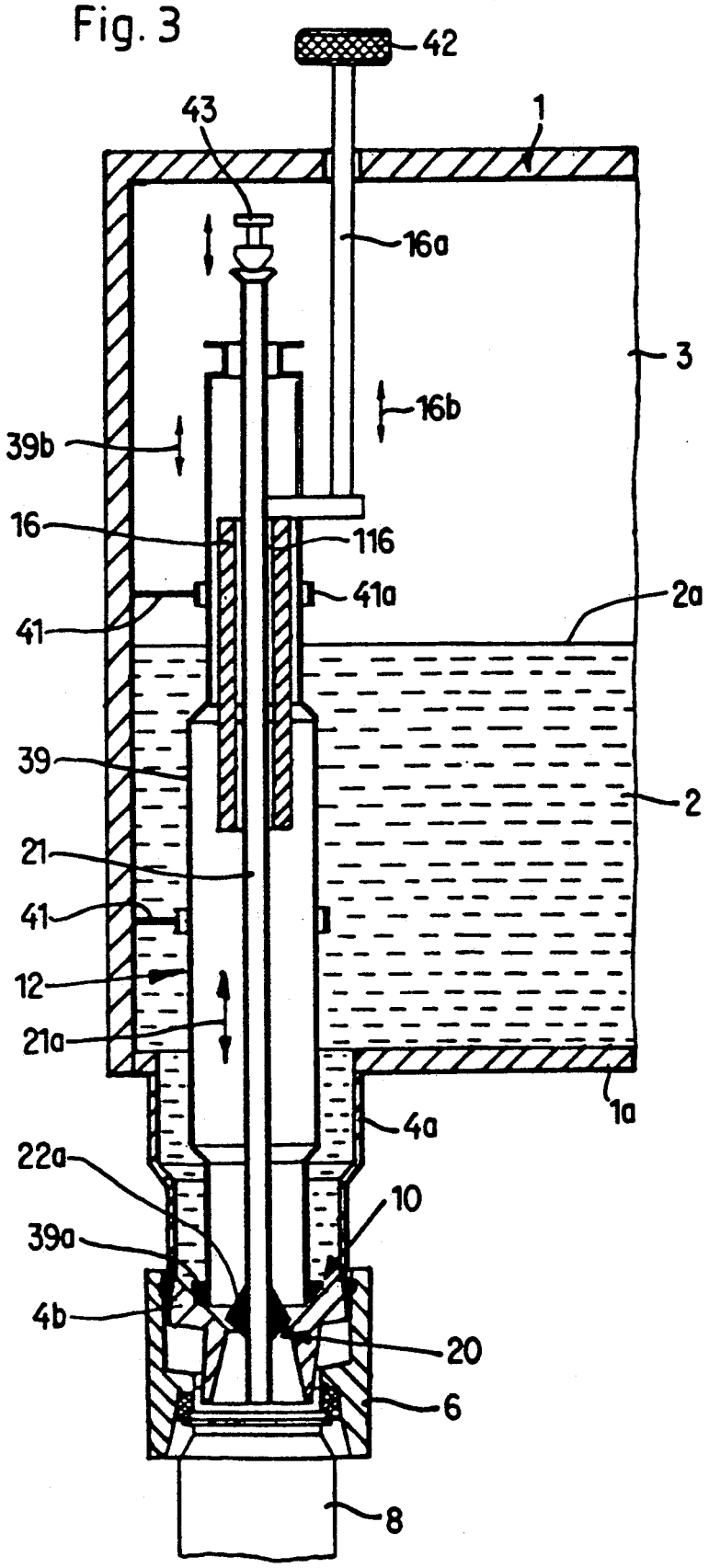
FIG. 3 is a similar fragmentary vertical sectional view of a third apparatus.

The apparatus which includes the filling unit of FIG. 3 has an annular tank 1 with a bottom wall 1*a* having an annulus of holes above tubular extensions 4*a* each of which spacedly surrounds and is preferably coaxial with an upright metering vessel 12 which is fully installed in the tank 1 and is movable up and down to expose or seal an inlet 10 which is located at the lower end of this vessel. The vessel 12 includes a relatively thin-walled elongated upright pipe 39. The lower end portion of the extension 4*a* carries a conical seat 4*b* which is surrounded by the sleeve 6 and cooperates with an annular external valving element 39*a* of the pipe 39 to either seal or to expose the inlet 10 which serves to admit liquid 2 from the tank 1 (i.e., from the respective extension 4*a*) into the metering chamber of the vessel 12. The valving element 39*a* can constitute a ring-shaped seal which is movable into and from engagement with the conical internal surface of the seat 4*b*.

The peripheral wall of the tank 1 carries brackets 41 for ring-shaped guide members 41*a* which surround and guide the adjacent portions of the pipe 39 during movement in either of the directions indicated by a double-headed arrow 39*b*. The cam and follower means for moving the pipe 39 up and down is not specifically shown in FIG. 3.

The seat 4*b* of the extension 4*a* which is shown in FIG. 3 cooperates with a valving element 22 of the pipe 21 to define an outlet 20 for admission of a metered quantity of liquid 2 from the metering chamber of the vessel 12 into the container 8 beneath the sleeve 6. When the pipe 21 is lifted relative to the pipe 39, the outlet 20 is exposed to permit a previously metered quantity of liquid 2 to leave the chamber of the vessel 12. In order to fill the chamber of the vessel 12, the pipe 39 is lifted relative to the seat 4*b* so that the liquid 2 enters the vessel 12 from below and rises to the level 2*a*. The liquid-receiving capacity of the metering chamber in the vessel 12 can be varied by raising or lowering the insert 16 by way of a knob 42 or other suitable handgrip means and rod 16*a*. The directions of movability of the insert 16 relative to the pipe 39 of the vessel 12 are indicated by the arrow 16*b*.

The pipe 21 and the insert 16 define a clearance 116 which permits the gas to escape from the vessel 12 into the plenum chamber 3 when the inlet 10 is open to admit liquid 2 into the pipe 39 from below. Such mode of admitting liquid is often desirable and advantageous because the flow of liquid into the vessel 12 is quiet and predictable (without turbulence) with a minimum of foaming and splashing.

The pipe 39 is lowered to seal the outlet 20 by moving the valving element 39*a* into sealing engagement with the seat 4*b* as soon as the filling of metering chamber in the vessel 12 including the pipe 39 is completed. The next step involves raising the pressure in the container 8 below the sleeve 6 prior to admission of metered quantity of liquid 2. This is achieved by opening a normally closed valve 43 at the upper end of the pipe 21 so that compressed air or another gas is free to flow from the plenum chamber 3, through the pipe 21 and into the container 8 below the sleeve 6. The pipe 21 is thereupon lifted to open the outlet 20 and to effect the admission of metered quantity of liquid into the container 8. Since the valve 43 is open, the descending liquid 2 can expel the gas from the container 8 back into the plenum chamber 3 through the pipe 21. The outlet 20 is thereupon closed again, the same as the valve 43, and the filling unit of FIG. 3 is ready for admission of liquid into the next container which is delivered to a position of alignment with the sleeve 6 in the same way as described in connection with FIGS. 1 and 5 or in another suitable way.

The filling unit of FIG. 3 can constitute but one of a complete annulus of filling units which can be distributed in the same way as the filling units 53 of FIG. 5, i.e., at the underside of a rotary annular tank 1. This renders it possible to fill large numbers of containers 8 per unit of time.

Figure 4:
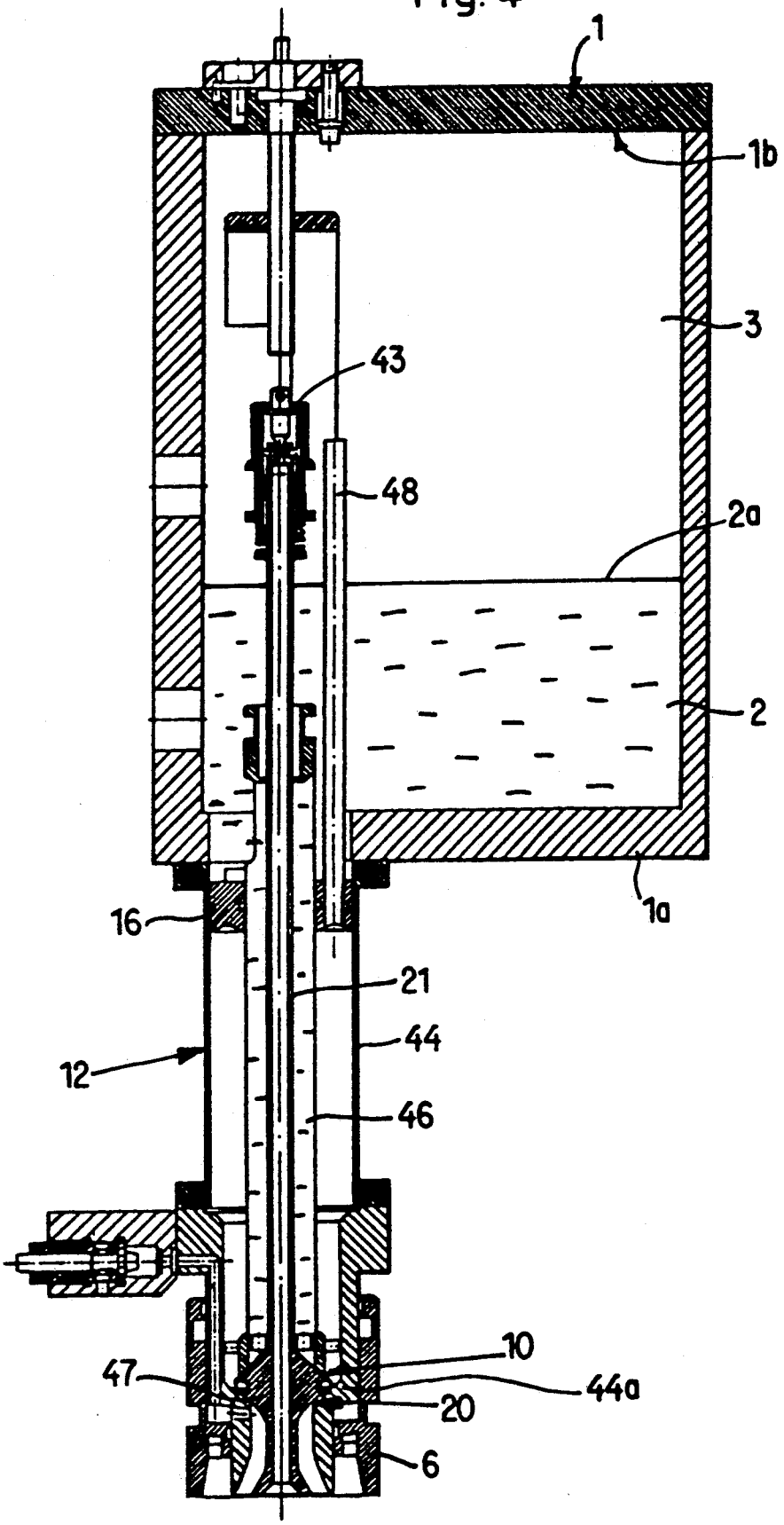
FIG. 4 is a similar fragmentary vertical sectional view of a fourth apparatus.

FIG. 4 shows a portion of an apparatus wherein the filling units constitute modifications of filling units of the type shown in FIG. 3. The entire metering vessel 12 of the filling unit of FIG. 4 is located beneath the bottom wall 1*a* of the preferably annular rotary tank 1. This tank preferably carries a complete annulus of filling units of the type shown in FIG. 4. The illustrated metering vessel 12 has an upright cylinder 44 which spacedly surrounds an upright tube 46. The latter can be said to form part of the tank 1 and is movable up and down to respectively expose and seal an inlet 10 between the valving element 47 at the lower end of the pipe 21 and the lower end of the tube 46. The valving element 47 and an inwardly extending bottom portion 44*a* of the cylinder 44 define an outlet 20 which is exposed in response to lifting of the pipe 21 relative to the tube 46. The metering chamber of the vessel 12 is an annular space between the cylinder 44 and the tube 46, and the liquid-receiving capacity of this metering chamber can be varied by an annular insert 16 in the cylinder 44. The upper end of the cylinder 44 has a flange which can be bolted, welded or otherwise sealingly secured to the bottom wall 1*a* of the tank 1. The upper end of the tube 46 is open and extends into the tank 1 to a level below the level 2*a* of the body of liquid 2 so that the tube 46 is always filled with liquid.

The annular insert 16 in the cylinder 44 of the metering vessel serves as a guide for the vertically movable tube 46 and as a seal for the upper end of the cylinder 44, i.e., liquid 2 can enter the metering chamber of the vessel 12 only through the lower end of the tube 46 but not through the upper end of the cylinder 44.

The upper end of the pipe 21 can be opened to admit compressed gas from the plenum chamber 3 into the container which is engaged by the sleeve 6. The latter surrounds and is movable up and down along the lower portion of the cylinder 44. The aforementioned valving element 47 at the lower end of the pipe 21 performs two functions, namely that of closing or exposing the inlet 10 (in cooperation with the lower end of the tube 46) and that of closing or exposing the outlet 20 (in cooperation with the bottom portion 44*a* of the cylinder 44).

When the outlet 20 is sealed by the valving element 47 and the bottom portion 44*a* of the cylinder 44, the tube 46 is lifted by a cam and follower assembly or the like (not shown) to expose the inlet 10 so that the tube 46 admits liquid 2 which fills the metering chamber of the vessel 12. A conduit 48 (e.g., an upright pipe) is installed in the bottom wall 1*a* to connect the upper end of the metering chamber in the vessel 12 with the plenum chamber 3 in the tank 1. This conduit enables the gas to escape from the metering chamber when the inlet 10 is open to admit a metered quantity of liquid 2 into the vessel 12. The capacity of the metering chamber is selected by appropriate adjustment of the level of the insert 16 in the cylinder 44.

The tube 46 is lowered to seal the inlet 10 as soon as the metering chamber of the vessel 12 is filled. The pressure in the container below the sleeve 6 is then raised as a result of opening of a valve at the upper end of the pipe 21 so that the latter can admit compressed gas from the plenum chamber 3 into the container (not shown) beneath the sleeve 6. The next step involves joint upward movement of the pipe 21 (and its valving element 47) and the tube 46 so that the inlet 10 remains sealed but the outlet 20 is exposed to permit the previously metered quantity of liquid to flow from the chamber of the vessel 12 into the container below the sleeve 6. At the same time, the pipe 21 establishes a path for the flow of expelled gas from the container into the plenum chamber 3. The outlet 20 is sealed (in response to lowering of the tube 46 together with the pipe 21) when the evacuation of liquid 2 from the metering chamber of the vessel 12 is completed.

The filling unit of FIG. 4 shares the advantage of the filling unit of FIG. 3, i.e., a metered quantity of liquid 2 enters the vessel 12 from below to avoid turbulence, splashing and foaming.

In the filling unit of FIG. 4, the outlet 20 is exposed in response to lifting of the pipe 21 relative to the vessel 12, and the inlet 10 is exposed in response to lifting of the tube 46 (i.e., of a movable portion of the tank 1) relative to the pipe 21. In the filling unit of FIG. 3, the outlet 20 is exposed in response to lifting of the pipe 21 relative to the seat **4*b* of the tank extension 4*a*, and the inlet 10 is exposed in response to lifting of the vessel 12 relative to the seat 4*b*. The filling unit of FIG. 3 can be modified by using a fixedly mounted (not reciprocable) metering vessel 12; this would necessitate the provision of a discrete valve which is to be actuated in order to expose or seal the inlet 10. By the same token, the vertically movable tube 46 of FIG. 4 can be replaced with a fixedly mounted tube if the respective filling unit comprises a discrete valve which can be actuated to expose or seal the inlet 10. It is also possible to provide discrete valves which control the outlets 20 of the filling units which are shown in FIGS. 3 and 4, i.e., vertical movements of the pipes 21 need not be relied upon to expose or seal the respective outlets 20. Reference may be had again to FIG. 2 which shows the vertically movable valving element 38 serving to control the inlets 37 between the compartment 1*b* of the tank 1 and the metering chamber of the vessel 32. Other types of valves can be used with equal or similar advantage. All that counts is to ensure that, in order to avoid foaming and/or other turbulence, the outlet 20 be located as close to the bottom end of the metering chamber as possible. This is accomplished by providing a tank 1** which has a portion extending close to the lure end of the lower section of the metering vessel.

The rods **16*a* which are used to select the levels of the inserts 16 (and hence the liquid-receiving capacities of the metering chambers) extend upwardly through and beyond the top wall of the respective tank 1. This is desirable and advantageous because the rods 16*a*** are readily accessible for manual or automatic adjustment, either individually, jointly or in groups of two or more. The means for effecting such adjustments are not specifically shown in the drawing.

An advantage of the improved apparatus is that the quantities of liquid 2 which are admitted into successive containers 8 of a short or long series of containers are no longer dependent upon the exact level of liquid in the tank 1 and/or upon the capacities of the containers 8. Thus, each container 8 can be filled to capacity or to less than capacity, depending upon the selected position of the respective insert 16.

Another advantage of the improved apparatus is its compactness. Such compactness is enhanced if at least the upper section of each metering vessel extends into the compartment **1*b* of the tank (FIGS. 1, 2 and 3**). Moreover, such mounting of the vessels (at least in part within the tank) is particularly desirable and advantageous when the tank contains a body of pressurized liquid.

An additional important advantage of the improved apparatus is that the adjustable inserts 16 can serve one or more additional purposes to thus enhance the simplicity and versatility of the apparatus. The inserts 16 which are shown in FIGS. 1 and 2 include the aforediscussed conduits 17 and contain the float valves 18. In addition, these inserts serve to guide the respective pipes 21. The insert 16 of FIG. 1 serves to guide the vertically movable upper section 13 of the respective vessel 12, and the insert 16 of FIG. 3 cooperates with the pipe 21 to define the annular clearance 116 for the flow of compressed gas between the metering chamber of the vessel 12 and the plenum chamber 3. The insert 16 of FIG. 4 guides the tube 46 and seals the upper end of the vessel 12 from the compartment **1*b* of the tank 1. In addition, the insert 16 of FIG. 4 can carry the conduit 48 which establishes a path for the flow of compressed gas between the plenum chamber 3 and the metering chamber of the vessel 12**. All this contributes to convenience of assembly and renders it possible to shorten the intervals of assembly or (when necessary) dismantling of the respective filling units.

The one-piece vessel 32 of FIG. 2 is especially compact and easy to install in the tank 1.

The float valves 18 of FIGS. 1 and 2 constitute desirable but optional features of the improved filling units. These valves render it possible to repeatedly fill the respective vessels 12 and 32 with identical quantities of liquid 2 because the admission of liquid into the metering chamber is terminated when the spherical valving element **18*a* of the float valve reaches and seals the seat 18*b* at the upper end of its chamber in the respective insert 16. The float valves 18 further ensure that the quantity of liquid 2 in the respective metering chambers is totally independent of the level 2*a* of liquid 2 in the respective tanks 1. All that is necessary is to ensure that the level 2*a* is located above the seat 18*b***.

A further important advantage of the improved apparatus and of its filling units is that each such filling unit comprises a relatively small or very small number of moving parts. For example, the filling unit 53 of FIG. 1 exhibits the advantage that the inlet 10 is defined solely by the two sections 4 and 13 of the metering vessel 12, i.e., it is not necessary to provide discrete valves to expose or seal the inlets of such filling units. The feature that the pipe 21 carries a valving element (22 or 47) which controls the outlet 20 also contributes to simplicity and compactness of the filling units. Thus, it is not necessary to provide separate valves and additional moving parts because the movements of the pipe 21 suffice to effect a sealing or an exposure of the outlet 20. Such simplification of the filling units contributes to their reliability.

Since the lower ends of the pipes 21 need not extend into the containers 8 below the respective centering sleeves 6, the sleeves 6 must perform relatively short strokes in order to rise above the level of oncoming empty or departing filled containers. This renders it possible to increase the output of the apparatus. It is to be mentioned here that the apparatus can be modified by providing the platforms 9 with means for raising and lowering the containers 8 relative to the centering sleeves 6. Reference may be had to the aforementioned copending patent application Serial No.

The filling unit 53 of FIG. 1 exhibits the additional advantage that the pipe 21 need not serve as a means for admitting gas which raises the pressure in the container 8 below the sleeve 6 (such function is performed by the additional conduit 29). This renders it possible to further raise the level of the lower end of the pipe 21 and to thus reduce the likelihood of contact between such lower end and the liquid which has already descended into the container 8. This reduces the likelihood of foaming of liquid in a filled container 8 because the internal surface of the pipe 21 does not carry a film of liquid. The step of raising the pressure in the container 8 does not involve spraying of any liquid into the container below the sleeve 6.

The connecting device 24 and the shuttle valve including the valving element 26 of FIG. 1 can be put to use during the last stage of transfer of a metered quantity of liquid 2 into a container 8 below the adjacent sleeve 6. This accelerates the outflow of liquid from the metering chamber of the vessel 12 well above the rate of outflow in the absence of the receptacle 27. As a rule, the rate of flow of liquid into a pressurized container will decrease during the last stage of admission of a metered or substantially metered quantity of liquid. However, a reduced rate of flow of liquid into a container during the last stage of the filling operation is often desirable and advantageous because this reduces the likelihood of splashing and foaming of admitted liquid.

The rate of liquid flow into a metering chamber is particularly advantageous if the filling units are constructed and assembled in a manner as shown in FIGS. 3 and 4, i.e., if the liquid flows upwardly from the lower ends of the metering vessels. This greatly reduces the likelihood of development of bubbles and other undesirable phenomena.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for filling containers with a liquid, comprising a liquid-containing rotary tank having a compartment including a liquid-containing lower portion and a plenum chamber which is filled with a compressed gas and is located above said lower portion; a plurality of metering vessels each having at least one sealable inlet for reception of liquid from said tank, at least one sealable outlet for admission of a metered quantity of liquid into a container and a liquid-receiving metering chamber, at least a portion of each of said vessels being disposed beneath and having a bottom portion remote from said tank; a container-centering and sealing device on each of said vessels; first conduits connecting said plenum chamber with the interior of the filled containers and having lower ends above the liquid levels of the filled containers which are centered by the respective devices; shutoff valves in said first conduits; and second conduits providing paths for the flow of gas between said plenum chamber and the metering chambers of said vessels.

2. The apparatus of claim 1, wherein at least a portion of said vessel is disposed in said tank.

3. The apparatus of claim 1, wherein said vessel has a first section beneath and a second section in said tank.

4. The apparatus of claim 3, wherein said first section is substantially cup-shaped and said vessel defines a liquid metering chamber having a first portion in said first section and a second portion in said second section.

5. The apparatus of claim 1, wherein said tank has a bottom wall and said vessel is a separately produced unit extending from below through said bottom wall and into said tank.

6. The apparatus of claim 5, wherein said vessel has a plurality of inlets in said tank and further comprising at least one valve for said inlets, said valve being movable relative to said vessel between a first position in which said inlets establish paths for the flow of liquid from said tank into said vessel and a second position in which said inlets are sealed.

7. The apparatus of claim 1, wherein said vessel has a first section outside of and a second section in said tank, said at least one inlet being disposed between said sections and said second section being movable relative to said first section between a first position in which said at least one inlet is exposed to establish a path for the flow of liquid from said tank into said vessel and a second position in which said at least one inlet is sealed.

8. The apparatus of claim 1, further comprising means for varying the liquid-receiving capacities of said chambers.

9. The apparatus of claim 8, wherein said means for varying the capacities of said chambers comprises inserts which are movable relative to the respective vessels to occupy selected portions of the respective chambers.

10. The apparatus of claim 1, wherein the liquid fills said tank to a first level and said paths have lower portions in communication with the respective liquid-receiving chambers beneath said level and upper ends in communication with said plenum chamber above said level, and further comprising float valves provided in said second conduits and arranged to seal the respective paths in response to filling of said vessels with liquid to a second level below said first level.

11. The apparatus of claim 1, further comprising means for varying the liquid-receiving capacity of said liquid-receiving chamber, said conduit forming part of said capacity varying means.

12. The apparatus of claim 1, wherein said devices are movable up and down along said portions of the respective vessels.

13. The apparatus of claim 12, wherein said portion of each of said vessels includes a hollow upright cylinder having an external surface and said devices are coaxial with the respective cylinders and surround and are vertically movably guided by the respective external surfaces.

14. The apparatus of claim 1, wherein each of said second conduits has a first end in communication with the interior of a container which is centered by the respective device an a second end connectable with said plenum chamber, said second conduits extending through the respective outlets, through the respective vessels and into said tank.

15. The apparatus of claim 14, further comprising means for moving each of said second conduits between a first and a second position, and valves arranged to seal said outlets and including valving elements provided on the respective second conduits and arranged to seal the respective outlets in one position of the respective second conduits.

16. The apparatus of claim 15, wherein said second conduits are at least substantially upright and said first ends are the lower ends of said second conduits, said moving means including means for moving said second conduits axially between a lowered position corresponding to said one position and a raised position corresponding to the other of said positions.

17. The apparatus of claim 1, wherein said first conduits have first ends communicating wit the interior of containers which are centered by the respective devices and second ends in communication with said plenum chamber, and valves provided in said first conduits to prevent the flow of compressed gas from said plenum chamber by way of said first conduits when the pressure at the first ends of said first conduits is below the pressure in said plenum chamber.

18. The apparatus of claim 1, further comprising a receptacle defining a chamber which is maintained at a pressure less than the pressure of compressed gas in the upper portion of said compartment, a pipe having a first end communicating with the interior of a container which is centered by said device and a second end, and means for selectively connecting said second end with said upper portion of said compartment or with the chamber of said receptacle.

19. The apparatus of claim 18, wherein said connecting means includes means for sealing said second end from said upper portion of said compartment when said at least one outlet admits liquid from said vessel into a container which is centered by said device.

20. The apparatus of claim 19, further comprising means for moving said pipe between first and second positions and a valve arranged to seal said at least one outlet in the first position of said pipe, said valve including a valving element provided on said pipe and sealing said at least one outlet in said first position of said pipe, said second end of said pipe being coupled to said connecting means in the second position of said pipe.

21. The apparatus of claim 1, wherein said tank is an annular tank.

22. The apparatus of claim 1, wherein said metering vessels together form an annulus of equidistant vessels.

23. The apparatus of claim 1, wherein said vessels have lower ends and said inlets are provided in the regions of the lower ends of the respective vessels.

24. The apparatus of claim 1, wherein said tank has a bottom wall and said vessel includes a portion movable in said tank relative to said bottom wall between first and second positions in which said at least one inlet is respectively open and sealed.

25. The apparatus of claim 24, wherein said bottom wall includes a valve seat and said portion of said vessel includes a valving element which engages said seat in the second position of said portion of said vessel.

26. The apparatus of claim 1, wherein said vessel includes a first portion which is integral with and extends downwardly form said tank and a second portion which is movably mounted in the interior of said tank, said device surrounding and being movable up and down relative to the first portion of said vessel.

27. The apparatus of claim 1, further comprising tubes, one for each of said vessels and each having a liquid-receiving first end immersed in the liquid in said tank and a liquid-discharging second end adjacent the respective bottom portion, said tubes being surrounded by the respective vessels and defining therewith the respective liquid-receiving metering chambers, said inlets being disposed between said liquid-discharging ends of the respective tubes and the respective bottom portions.

28. The apparatus of claim 27, wherein said devices include sleeves which surround and are movable up and down along said portions of the respective vessels.

29. The apparatus of claim 27, further comprising means for moving said tubes relative to the respective bottom portions between first positions in which the respective inlets admit liquid from said liquid-discharging ends into the respective chambers and second position in which said tubes seal the respective inlets.

30. The apparatus of claim 29, wherein said tubes include a hollow cylinders and said moving means includes means for moving the cylinders axially between said first and second positions.

* * * * *